United States Patent [19]

Couturier et al.

[11] Patent Number: 4,997,338

[45] Date of Patent: Mar. 5, 1991

[54] SHORT COUNT SHEET SEPARATOR

[75] Inventors: Dennis P. Couturier, Washburn; Edward R. Ochsenbauer, Ashland, both of Wis.

[73] Assignee: C. G. Bretting Manufacturing Co., Inc., Ashland, Wis.

[21] Appl. No.: 347,146

[22] Filed: May 3, 1989

[51] Int. Cl.[5] ..... B65H 31/32

[52] U.S. Cl. ..... 414/790.8; 414/790.3

[58] Field of Search ..... 414/789.1, 790, 790.1, 414/790.3, 790.8, 924

[56] References Cited

U.S. PATENT DOCUMENTS

| | | | |
|---|---|---|---|
| 3,051,479 | 8/1962 | Gore | 414/788.9 X |
| 3,088,604 | 5/1963 | Nilsson | 414/789.1 X |
| 4,425,068 | 1/1984 | Wilson | 414/789.1 |
| 4,432,685 | 2/1984 | Stauber | 414/790.3 X |
| 4,439,083 | 3/1984 | Jenkins | 414/790.3 |
| 4,601,394 | 7/1986 | Hunter | 414/790.3 X |

*Primary Examiner*—David A. Bucci
*Assistant Examiner*—Craig Slavin
*Attorney, Agent, or Firm*—Faegre & Benson

[57] ABSTRACT

A short count sheet separator for separating relatively short count clips of laminar products or cut sheets having horizontally extending table top fingers for supporting a continuously building stack of laminar products and a rotatable count finger assembly having a plurality of count fingers extending radially therefrom and rotatable into and out of the stack building path and further having a pusher finger to displace a relatively short count clip of the laminar products from the stack building path.

17 Claims, 9 Drawing Sheets

SHORT COUNT SHEET SEPARATOR

BACKGROUND OF THE INVENTION

This application relates to apparatus for stacking cut sheets such as paper napkins and the like into a stack and separating successive clips or packages each made up of a predetermined number of sheets. In the past, such machines have been relatively slow, and have been either unadjustable as to the number of sheets in a clip or package, or have had a very limited range of adjustment in the number of sheets in a clip.

SUMMARY OF THE INVENTION

The present invention provides for an adjustable count separator to separate clips or packages of a predetermined number of sheets or laminar products from a continuously building stack by providing a horizontally extending table top finger for supporting a continuously building stack of laminar products which are built in a stack building path. A rotatable count finger assembly is preferably positioned above the table top finger and has a plurality of radially projecting count fingers (preferably two or four) selectively rotatable to a vertical clearance position out of the stack building path. The rotatable count finger assembly is further rotatable to a horizontal position wherein the count fingers interfere with (or are interposed in) the stack building path at a position above the table top finger to enable continued building on top of the count finger when it is located in the horizontal interference position. Finally, a pusher finger is located preferably adjacent one side of the stack building path and extends above the table top finger. The pusher finger is movable in a direction transverse to the stack building path to displace the clip of laminar products from the stack building path. The pusher finger preferably delivers the clip to discharge a conveyor located adjacent the table top finger.

DETAILED DESCRIPTION

Figure 1:
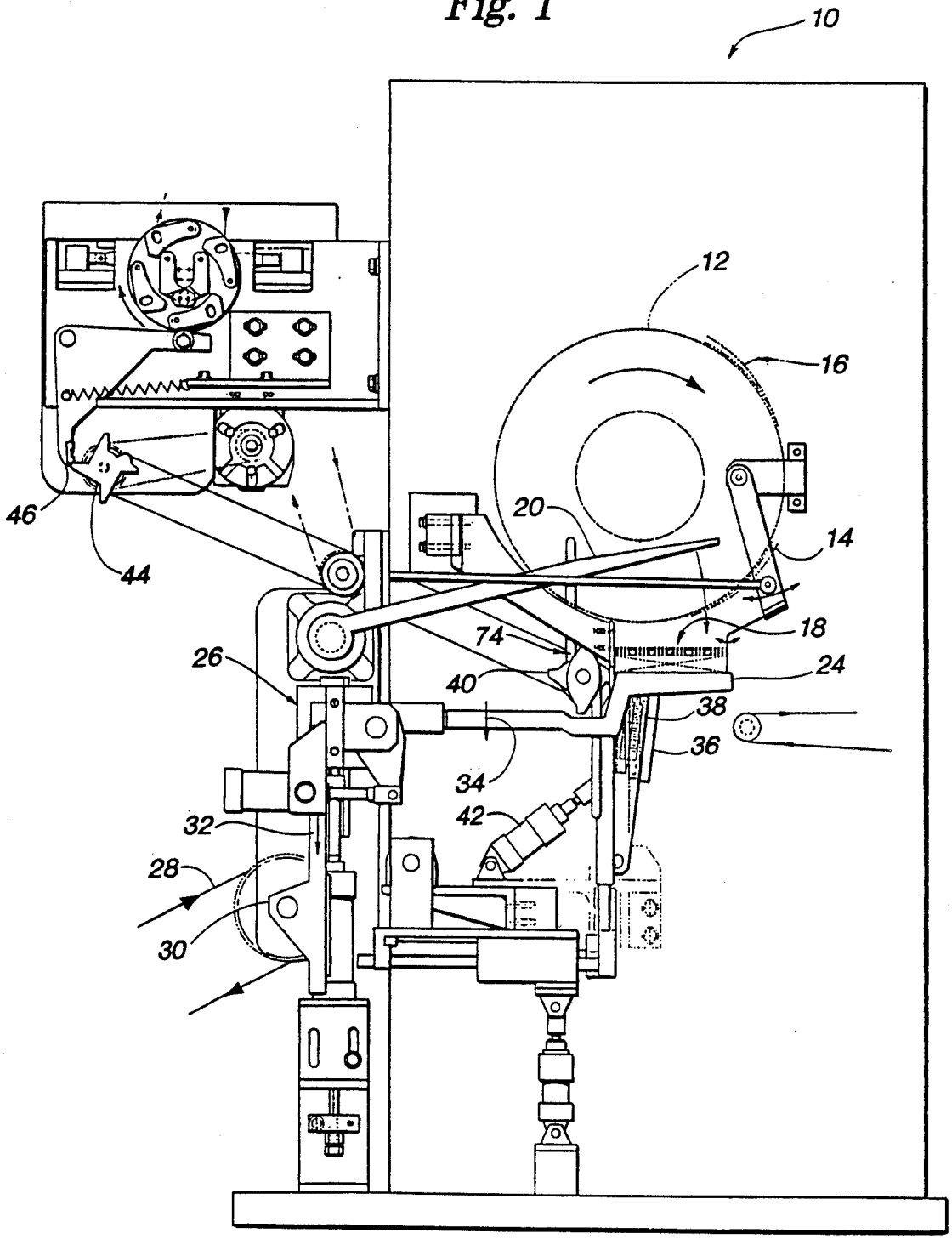
Figure 2:
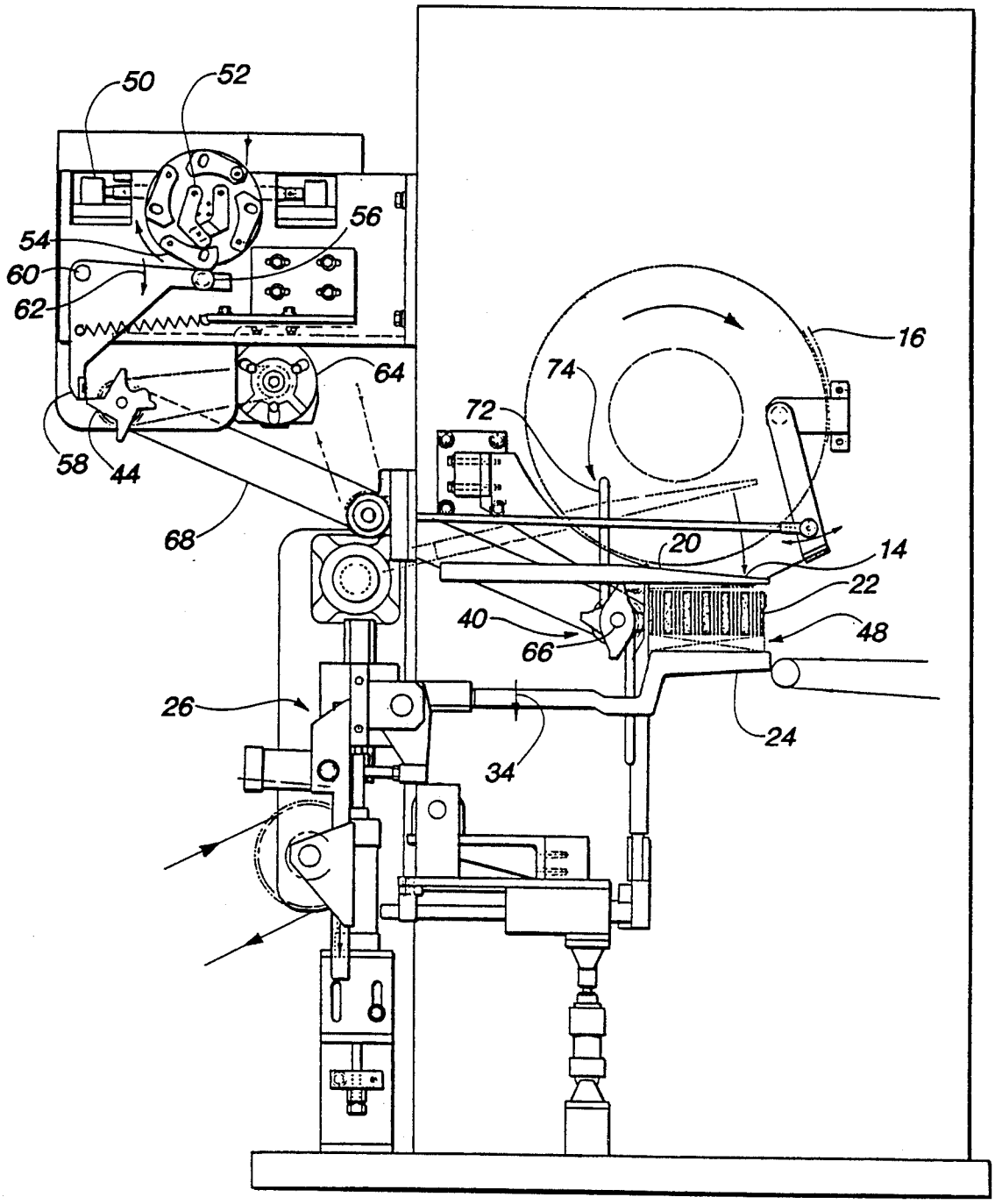

Referring now to the Figures, and more particularly to FIG. 1, an apparatus for separating relatively short count clips or packages of laminar products such as paper napkins in a continuously building process stack may be seen. Apparatus 10 preferably includes a packer roll 12 which carries successive cut sheets 14, 16, to a stack building path 18. Packer fingers 20 are preferably provided to aid in the discharge of cut sheets 14, 16 from roll 12. Sheets 14, 16 may be held on roll 12 by conventional vacuum means (not shown). Referring now also to FIG. 2, cut sheet 14 has been transferred from roll 12 to a stack 22 by packer fingers 20. Stack 22 is preferably built on a table top finger 24. In operation, the table top finger can be positioned relatively high, as shown in FIG. 1, and driven gradually downward as shown in FIG. 2 as the stack 22 builds. It is to be understood that this mode of moving the table top finger is preferable for building stacks approximately in the range of up to 60 cut sheets or napkins. The present design has been found suitable for separating short count clips in the range of 16 to 60 sheets. The table top finger 24 is preferably driven by a package building carriage 26 powered by a package building drive input 28 through a pinion gear 30 driving against a rack gear 32. The table top finger 24 and carriage 26 preferably move in a downward direction 34 parallel to stack building path 18.

First and second count finger stops 36, 38 are preferably provided to engage a rotatable count finger assembly 40. In the position shown in FIG. 1, the second count finger stop 38 moves into an actuated position for a next count trip as the first count finger stop 36 is moved out to a deactuated position by operation of air cylinder 42. As the first count finger stop 36 moves out, a count finger drive bracket 44 rotates into contact with a count finger trigger wear plate 46.

Referring now more particularly to FIG. 2, the package building carriage 26 continues to move downward in direction 34 as packer fingers 20 pack a final napkin 14 on stack 22 which will become a first package or clip 48. At this time a compact air cylinder 50 fires, extending pivot arm 52 pivoting a cam 54 outward. A cam follower 56 follows cam 54 outward, pivoting a count finger trigger 58 about pivot 60 by rotating in direction 62. This releases the count finger drive bracket 44. Bracket 44 is preloaded with torque from an air motor 64. Bracket 44 begins to move clockwise about a count shaft 66 on which the count finger assembly 40 is rotatably mounted. Bracket 44 is preferably connected to assembly 40 via a timing belt 68. Timing belt 68 drives assembly 40 clockwise causing the assembly 40 to move to position 70 shown in FIG. 3. Assembly 40 has a generally radially extending, but offset count finger 72 which is moved out of a vertical clearance position 74 shown in FIG. 2, to the horizontal interference position 70 shown in FIG. 3. Count finger 72 makes contact with package 48 located between count finger 72 and table top finger 24. Cam plate 76 rotates clockwise as cam follower 56 moves past cam 54 and resets the count finger trigger 58. Package building carriage 26 continues to move downward until count finger 72 comes to rest horizontally in position 70.

Figure 3:
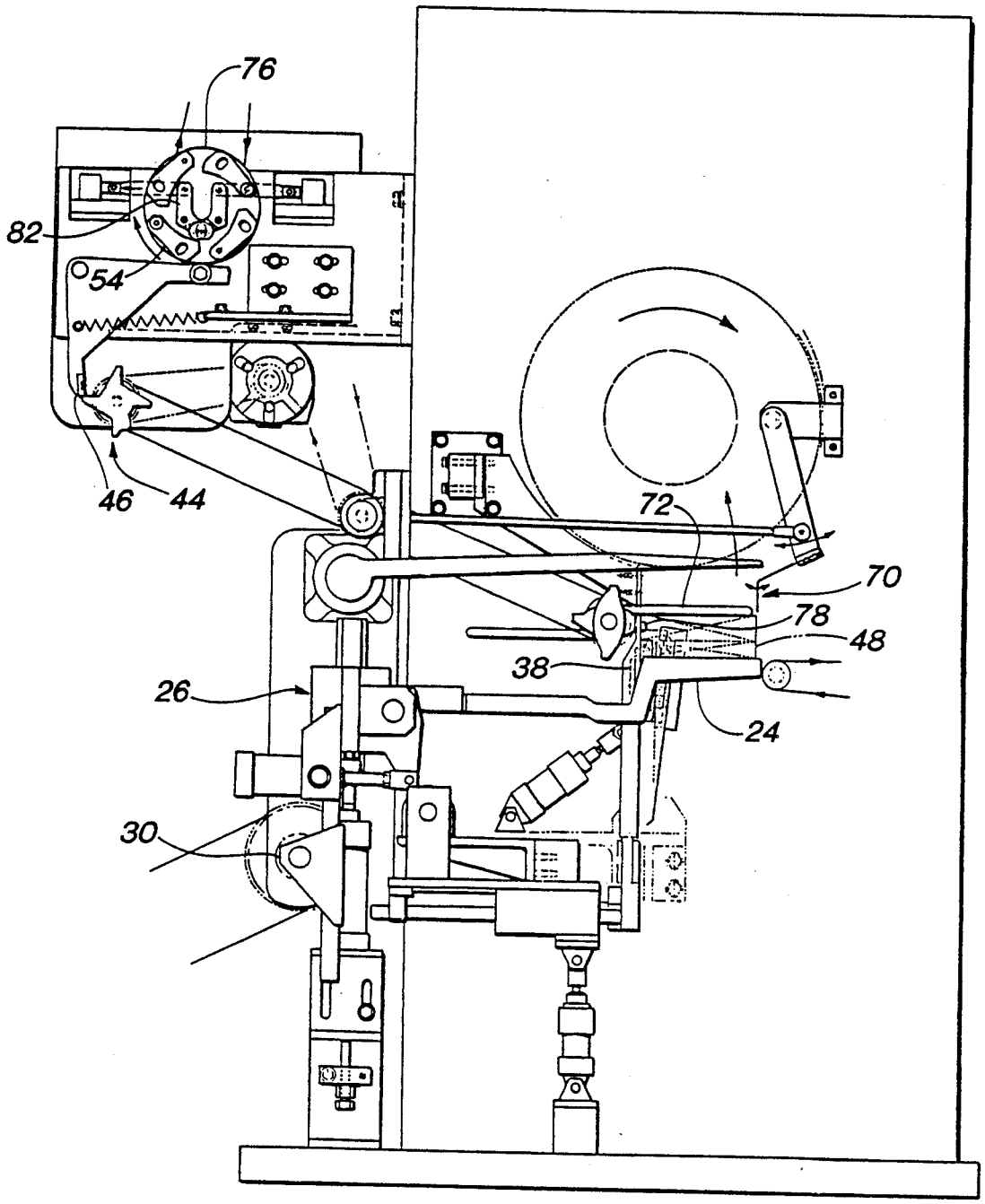
Figure 4:
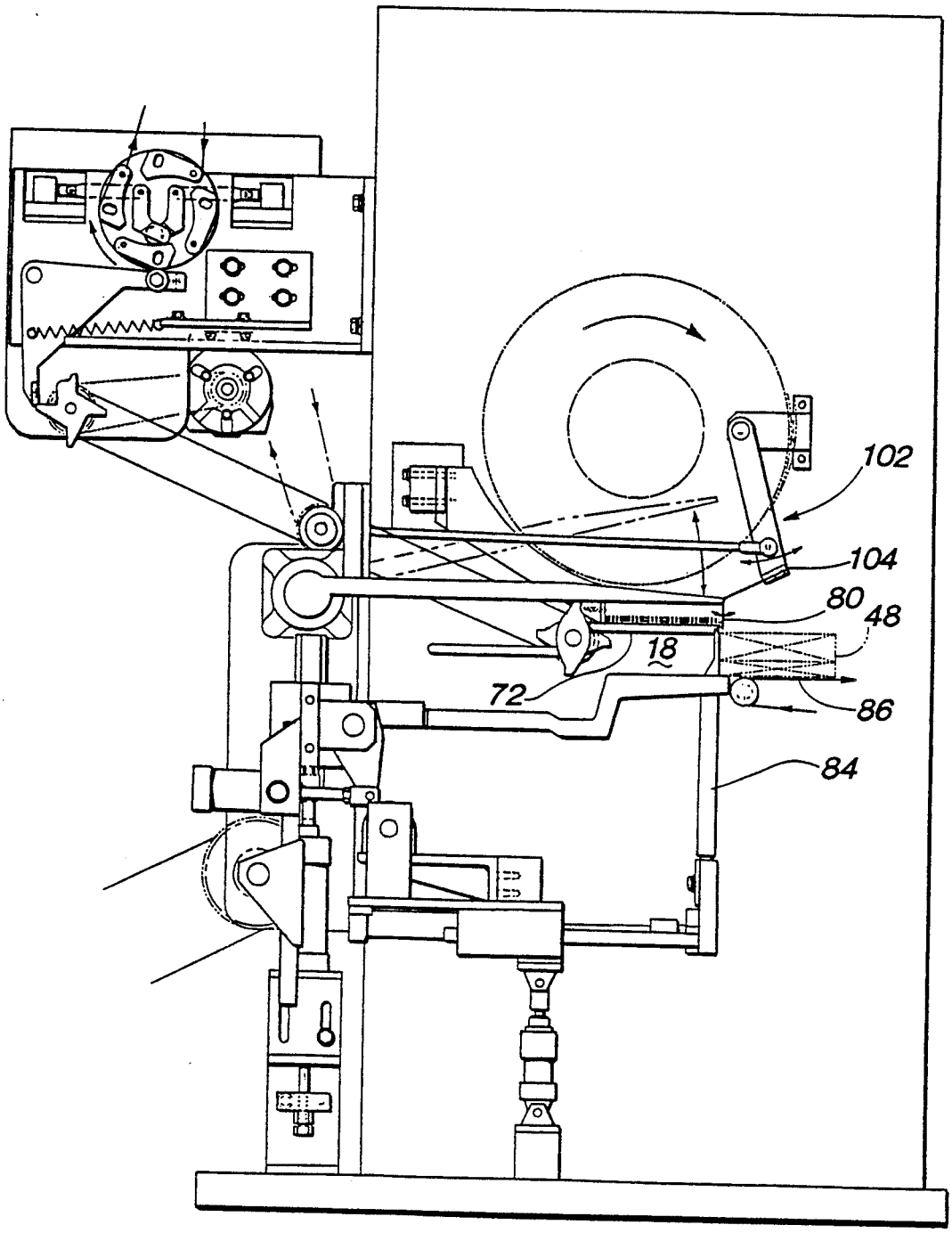

As shown in FIG. 3, a count shaft stop 78 hits the second count finger stop 38 as count finger 72 comes to rest in horizontal position 70, providing a platform for continued stack building of a second clip or package 80 as shown on FIG. 4. Preferably, no contact is made at this time between the count finger trigger wear strip or plate 46 and the count finger drive bracket 44. At this time the first package or clip 48 lies between the count finger 72 and the table top finger 24.

Cam plate 76 continues to rotate clockwise as the compact air cylinder 50 retracts causing pivot arm 82 to return cam 54 to its low point.

The package building carriage 26 and table top finger 24 preferably stop downward movement upon actuation of a clutch (not shown) on the shaft of pinion gear 30. Carriage 26 remains at the height shown in FIG. 3 until the first package 48 is discharged.

Referring now more particularly to FIG. 4, a pusher finger 84 pushes package 48 out of stack building path 18 and onto a belt conveyor 86 while package building continues on finger 72.

Figure 5:
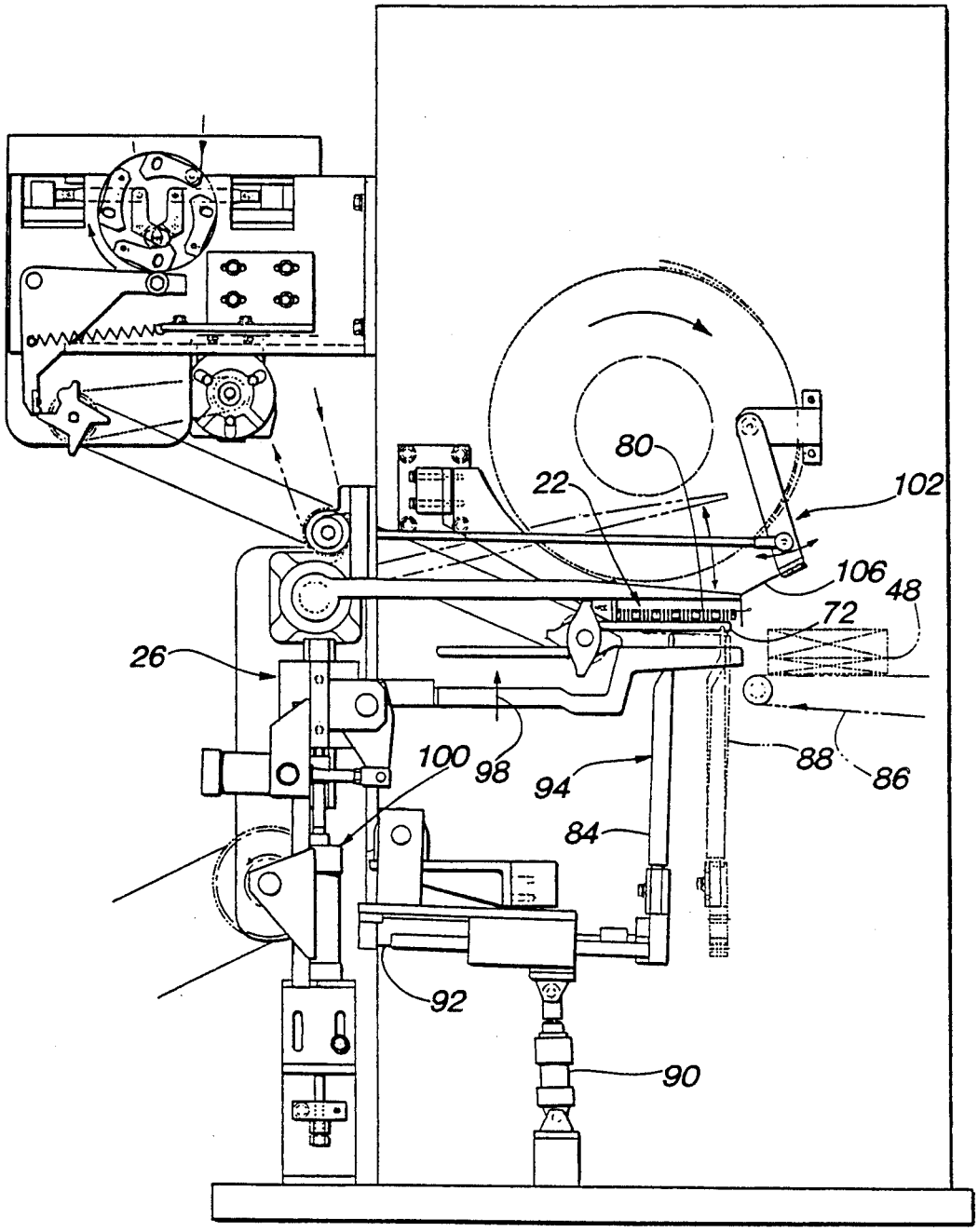

Referring now more particularly to FIG. 5, the second package 80 continues to be built on count finger 72. Pusher finger 84 preferably retracts first vertically, to a first intermediate position 88 preferably traversing a range of approximately one-quarter inch for napkin clearance. This retraction may be accomplished by retraction of air cylinder 90. Pusher finger 84 is also retracted horizontally by actuation of air cylinder 92 causing horizontal movement of finger 84 to a second intermediate position 94. Package building carriage 26 is returned towards its home position 96 (see FIG. 6) by vertical movement upwards in direction 98 caused by actuation of air cylinder 100.

Figure 6:
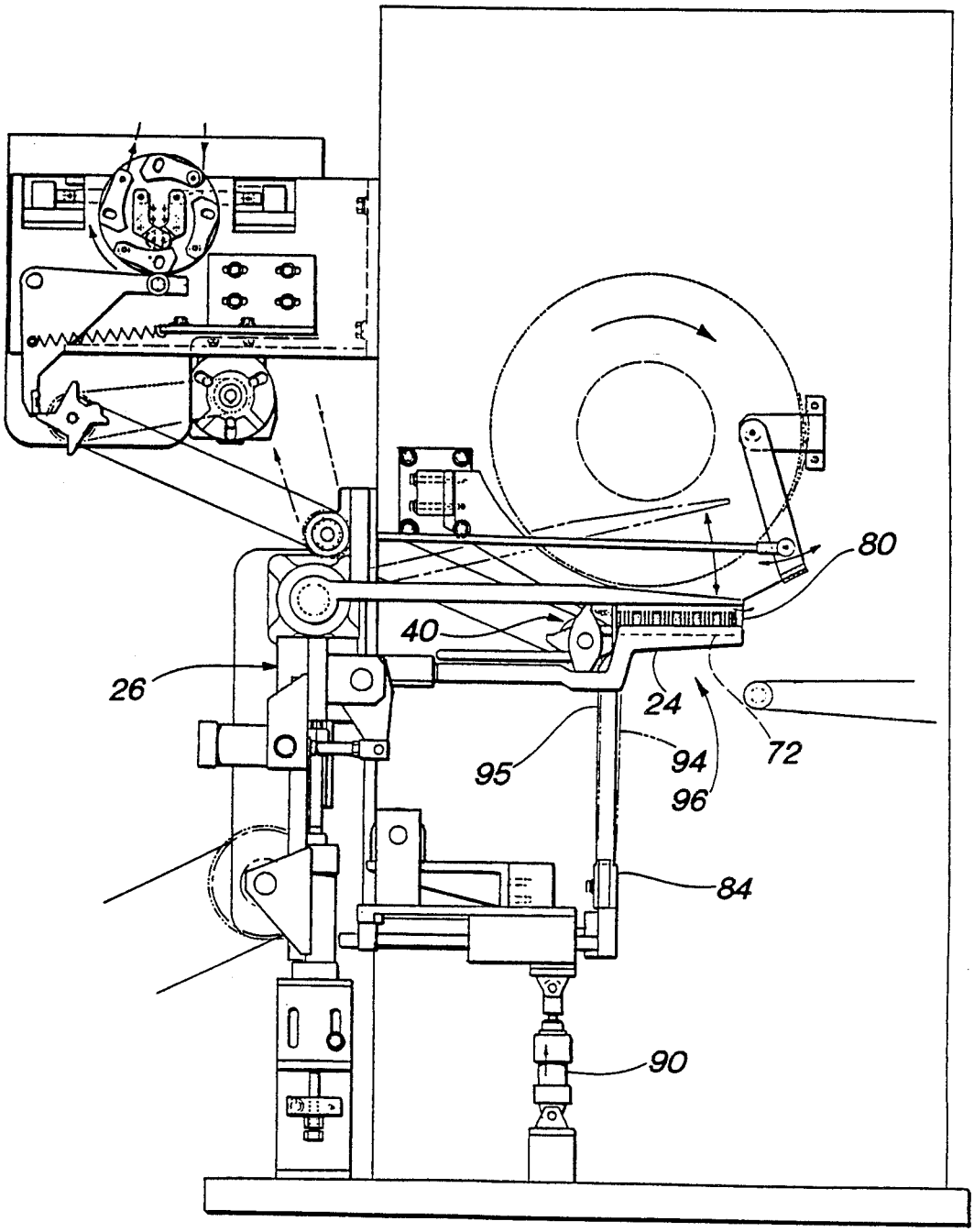

Referring now more particularly to FIG. 6, package building carriage 26 is shown at its home position 96 where table top finger 24 is at a height equal to count finger 72 such that package 80 remains undisturbed as count finger 72 and assembly 40 are reset to the vertical clearance position 74 shown in FIGS. 1 and 2. Pusher finger 84 is returned to a home position 95 after an upward movement of pusher finger 84 of approximately one-quarter inch caused by extension of air cylinder 90.

After a number of sheets have been stacked into package 80, compact air cylinder 50 actuates, causing rotation of assembly 40 clockwise 90° such that count finger 72 is downwardly pointing after completion of this cycle. It is to be understood that after count finger 72 drops, package 80 remains supported by table top finger 24. The count shaft stop 78 hits the first count finger stop 36 as the count finger 72 comes to rest vertically in a downward direction. Package 80 continues to build on table top finger 24. Pinion gear 30 drives rack 32 attached to carriage 26 downward along with table top finger 24. It is to be understood that there are two count shaft stops 78, each with two lobes located 180° apart on shaft 66. The first and second count shaft stops 78 are displaced axially from each other and radially 90° apart. The first and second count finger stops 36, 38 are adapted to engage each of the lobes of the count shaft stop 78.

The process of separating clips described above repeats itself indefinitely, for as long as stack building continues, proceeding with a cycle of FIGS. 1–6 to provide separation of clips from the process building stack 22, delivering the clips or packages via discharge conveyor 86.

If relatively few sheets (e.g. 16–20) are to be included in a short count clip, it has been found preferable to move conveyor 86 manually upward to be aligned with finger 24 in the position shown in FIG. 6. This mode eliminates the need to operate carriage 26 and is made possible by the relatively short height of a 16–20 count package or clip. It is to be understood that in a preferred embodiment, there may be seven-eighths of an inch to one inch distance between packer finger 20 in its lowermost position as shown in FIG. 3, and the stack building platform formed by either table top 24 or count finger 72. It is further to be understood that in a preferred embodiment the count finger 72 is approximately one-half inch thick. For a relatively small number of sheets in clip 80, the clip height is approximately one to one and one-quarter inches which permits operation without vertical movement of carriage 26. However, for a count in the region of 60 sheets, the clip height is two and one-half to approximately three and one-half inches, thus necessitating the vertical movement of table top finger 24 to accommodate the increased clip height.

It has further been found useful to provide a tamper mechanism 102 (see FIGS. 4 and 5) to tamp sheets 14, 16 as they are transferred by packer finger 20 from roll 12 to stack 22. FIG. 4 shows tamper mechanism 102 in a first position 104 and FIG. 5 shows mechanism 102 in a second position 106. It is to be understood that mechanism 102 reciprocates preferably in synchronism with the roll 12 and packer fingers 20 and is designed to have an adjustable phase angle with respect to operation of roll 12 and fingers 20 to provide adjustability in tamping sheets 14, 16 as they are placed on stack 22. Tamper mechanism 102 thus provides greatly improved alignment of sheets 14, 16 in stack 22. The tamper mechanism or means 102 preferably reciprocates transverse (horizontally) to stack building path 18 (which preferably is vertical).

Figure 7:
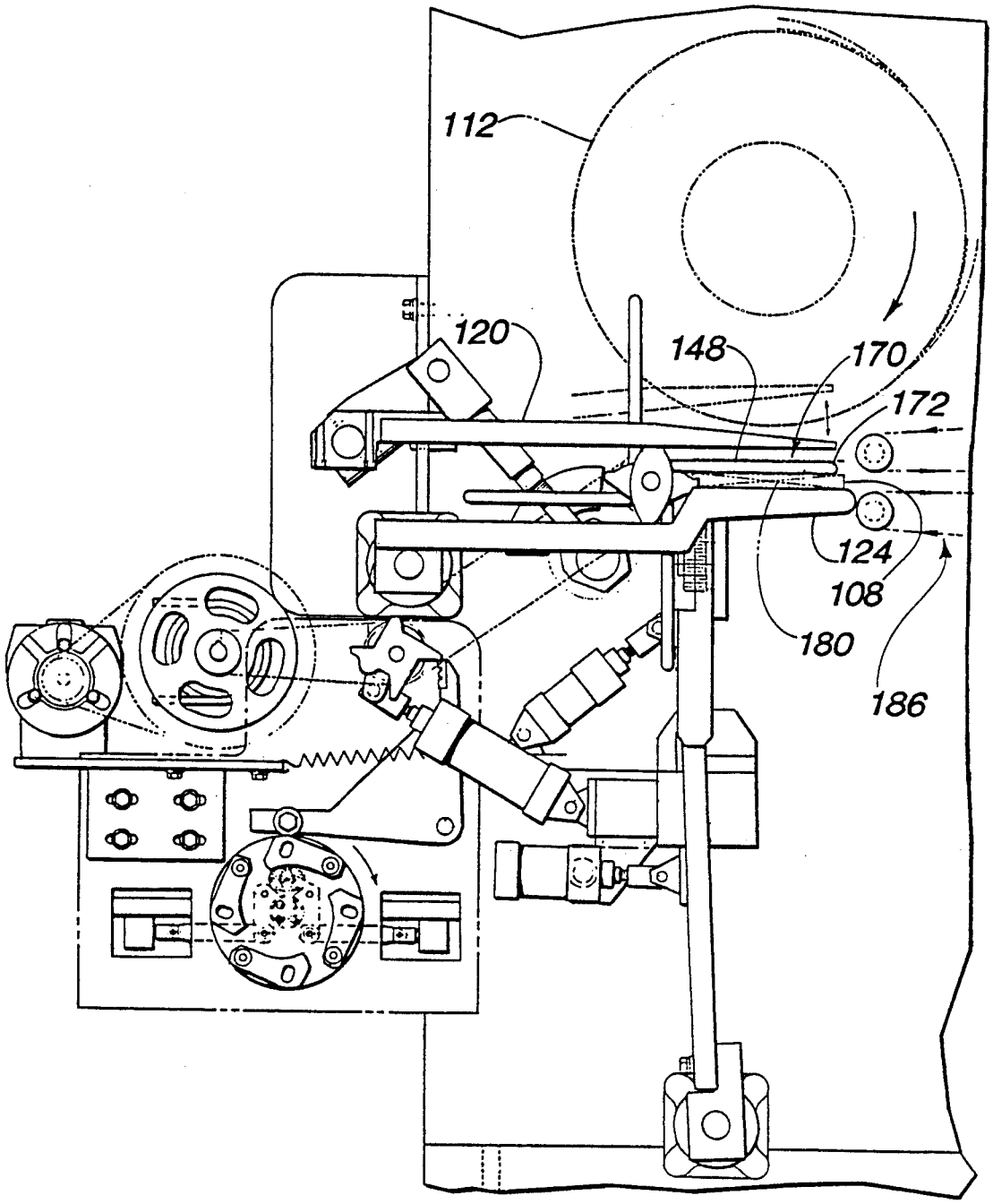
Figure 8:
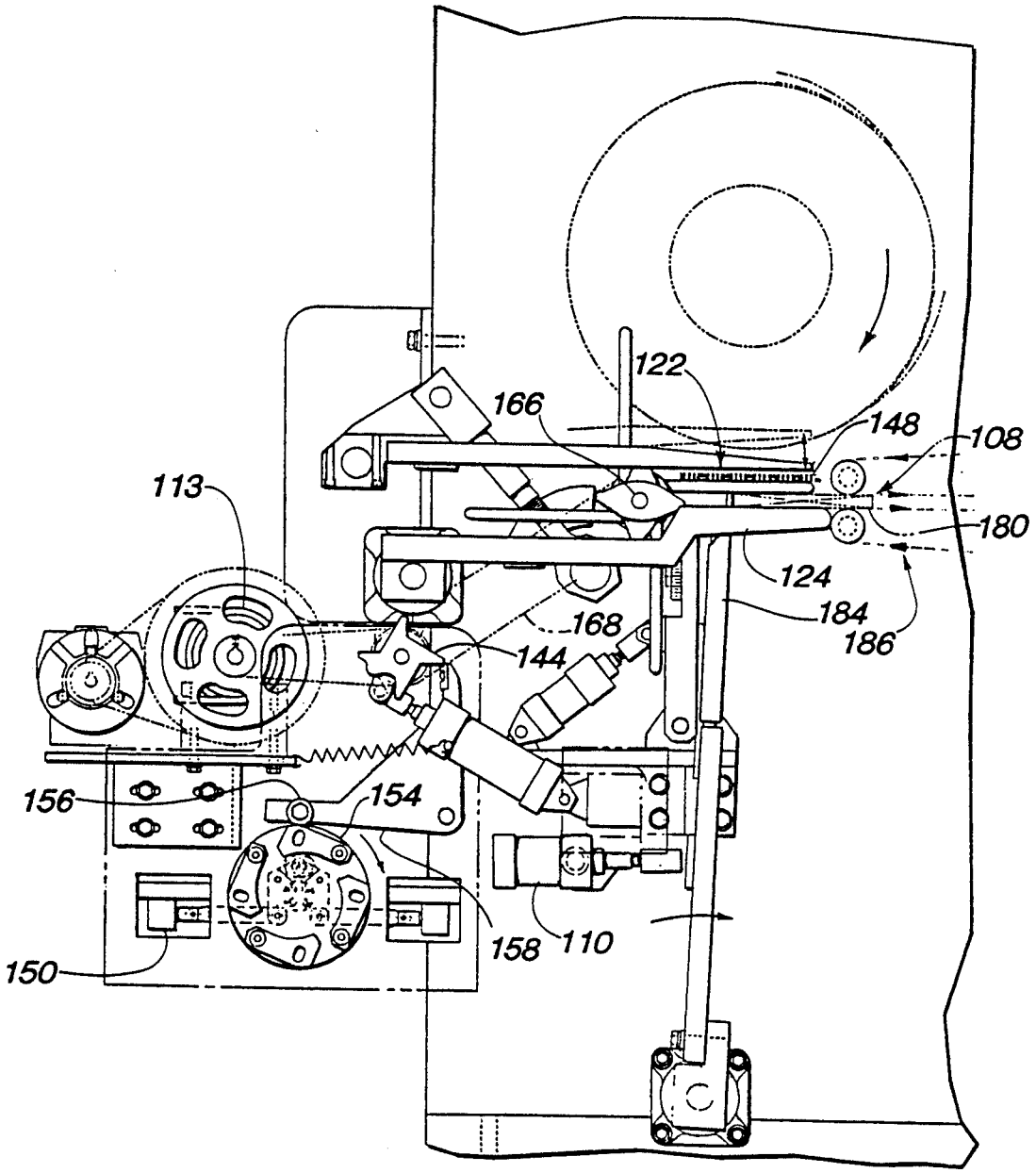
Figure 9:
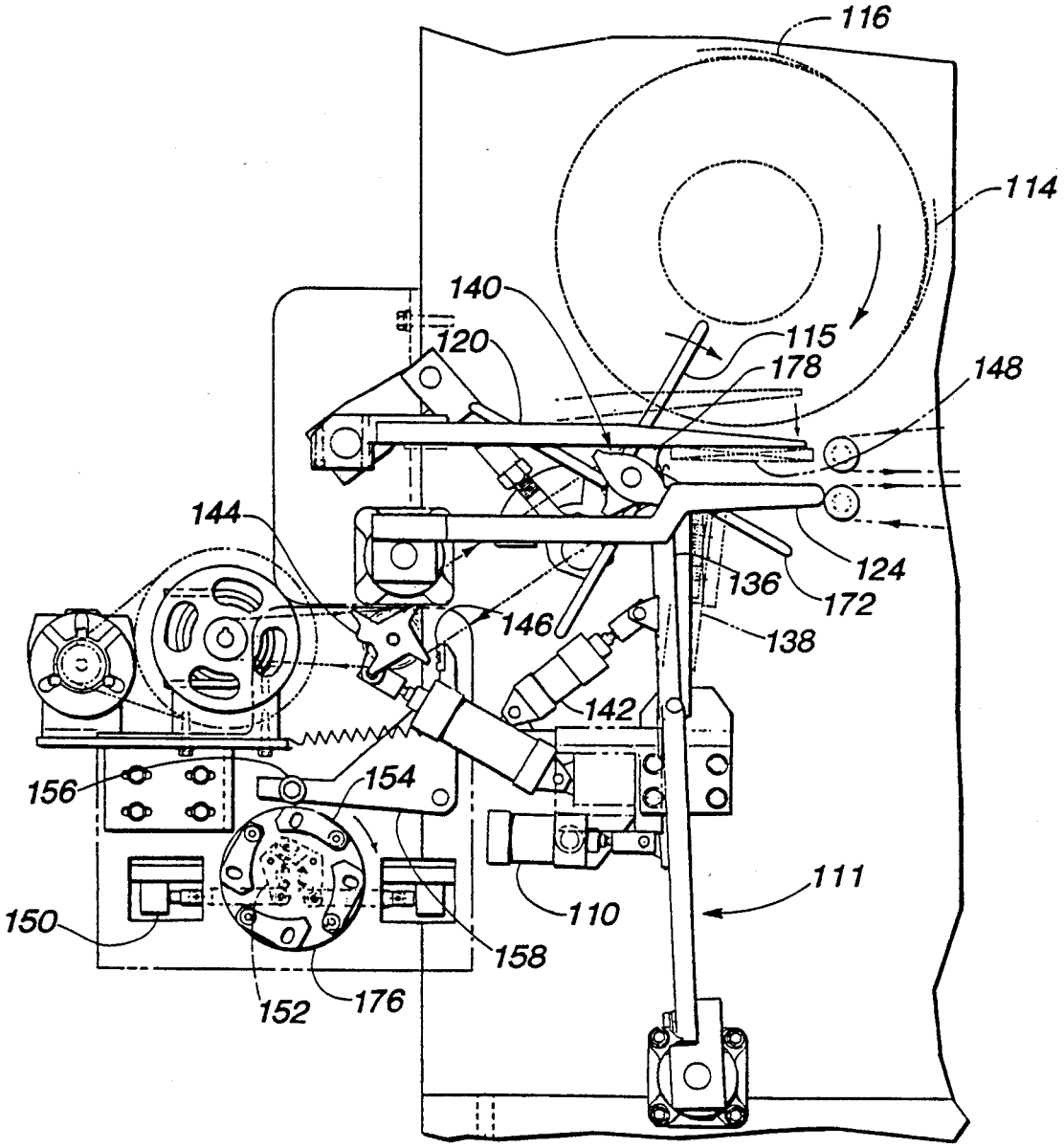

Referring now to FIGS. 7–9 and more particularly to FIG. 7, an alternative embodiment of the present invention may be seen. In this embodiment, four count fingers are shown; and it is to be understood that the embodiment of FIGS. 1–6 may also include four count fingers for packing and separating stacks at the low end of the range (e.g., 16–20 sheets/clip). In such case, the operation of pusher finger 84 will occur twice as often to separate clips formed by the four-count finger assembly 40.

Referring now more particularly to FIG. 7, a first package 148 is being built on count finger 172. Packer finger 120 packs a folded napkin off packer roll 112 in a downward motion onto count finger 172. The napkins in stack 122 build on count finger 172.

A previously built package 180 drops down to table top finger 124 and is ready for transfer to a belt nip 108 in conveyor 186. Referring now to FIG. 8, package 180 is pushed by pusher finger 184 upon actuation by air cylinder 110 as pusher finger 184 pushes package 180 into conveyor 186, package 180 is pulled by belt nip 108. Package 180 is pulled off table top finger 124 by belt nip 108 as pusher finger 184 returns to a home position 111 caused by a return stroke of air cylinder 110, as shown in FIG. 9.

Once packer finger 120 packs the final napkin on package 148, the compact air cylinder 150 extends, pivoting cam 154 out. A cam follower 156 follows cam 154 outward which pivots a count finger trigger and releases a count finger drive bracket 144. Count finger drive bracket 144 is preloaded with torque created by a wound wrap spring clutch 113. The count finger drive bracket 114 begins to rotate clockwise driving count shaft 166 of count finger assembly 140 via a timing belt 168.

Referring now more particularly to FIG. 9, just after count finger trigger 158 releases the count finger drive bracket 144, clutch 113 drives the count finger shaft 166 clockwise (shown at 30° rotation in FIG. 9). Count finger 172 drops from beneath package 148 and the next count finger 115 drives package 148 to the table top finger 124. Packer fingers 120 move counter-clockwise as count finger assembly 140 rotates clockwise.

Cam plate 176 rotates clockwise as cam follower 156 rolls off cam 154 and resets count finger trigger 158. As assembly 140 continues to rotate, count shaft stop 178 hits a first count finger stop 136 as count finger 115 comes to rest in horizontal position 170 (see FIG. 7). No contact is made between count finger trigger wear plate 146 and count finger drive bracket 144. Package 148 will then lie between count finger 115 and table top finger 124. Cam plate 176 will continue to rotate clockwise as compact air cylinder 150 retracts, pivoting arm 152 and returning cam 154 to its low point.

The first count finger stop 136 is then moved out of position and the second count finger stop 138 is moved into position for the next trip by actuation of air cylinder 142. The count finger drive bracket 144 then rotates into contact with count finger trigger wear plate 146.

Packer fingers 120 pack further sheets 114, 116 at the start of a new package and the entire process is repeated as a stack 122 is built.

The invention is not to be taken as limited to all of the details thereof as modifications and variations thereof may be made without departing from the spirit or scope of the invention.

What is claimed is:

1. Apparatus for separating relatively short count clips of laminar products from a continuously building stack comprising:

(a) a horizontally extending table top finger for supporting a continuously building stack of laminar products in a stack building path;

(b) a rotatable count finger assembly positioned above the table top finger and having a plurality of count fingers projecting radially therefrom with the count fingers selectively rotatable about an axis to a stationary vertical clearance position out of the stack building path and to a stationary horizontal interference position in the stack building path above the table top finger, and (c) a pusher finger adjacent one side of the stack building path and extending above the table top finger and movable transverse to the stack building path to displace a relatively short count clip of the laminar products from the stack building path.

2. The apparatus of claim 1 further comprising a reciprocating tamper means for aligning the laminar products as they are continuously built into the stack.

3. The apparatus of claim 2 wherein the tamper means reciprocates transverse to the stack building path.

4. The apparatus of claim 1 wherein the count finger assembly comprises two diametrically opposed count fingers.

5. The apparatus of claim 1 wherein the count finger assembly comprises four diametrically opposed count fingers.

6. The apparatus of claim 1 wherein the count fingers are offset from a radius of the count finger assembly and extend generally tangentially to the axis.

7. The apparatus of claim 1 wherein the table top finger is movable parallel to the stack building path.

8. The apparatus of claim 7 wherein the table top finger moves downward as stack building continues.

9. The apparatus of claim 8 wherein the table top finger is moved by a programmable carriage.

10. The apparatus of claim 1 further comprising a belt conveyor positioned adjacent the table top finger when the pusher finger displaces the clip from the stack building path.

11. A method of separating a relatively short count clip of laminar products from a continuously building stack comprising the steps of:

(a) continuously building a stack of laminar products on a table top finger in a vertically-oriented stack building path;

(b) rotating a count finger about an axis from a stationary vertical position out of the stack building path to a horizontal position above the table top finger and in the stack building path such that the stack builds on the count finger, and a short count clip of laminar products separated from the stack by the count finger is positioned between the count finger and the table top finger; and (c) pushing the clip transversely off of the table top finger and out of the stack building path.

12. The method of claim 11 further comprising the additional step of:

(d) rotating the count finger out of the stack building path such that the stack continues to build on the table top finger.

13. The method of claim 11 wherein step (a) further comprises tamping the laminar products transverse to the stack building path such that the laminar products are uniformly aligned in the stack.

14. A method for separating relatively short count clips from a continuously building stack of non-interfolded sheets comprising the steps of:

(a) building a stack on a table top finger and moving the table top finger downward as the stack height increases;

(b) actuating a rotatable count finger assembly from a deactuated position out of a stack building path to an actuated position in the stack building path;

(c) capturing a clip of a predetermined short count number of sheets of the stack between a count finger projecting from the count finger assembly and the table top finger;

(d) transversely pushing the clip out of the stack building path and commencing building a new clip in the stack building path on the count finger projecting into the stack building path;

(e) advancing the table top finger towards the projecting count finger in an upstream direction of the stack building path; and (f) rotating the count finger assembly to move the count finger out of the stack building path to permit continued stack building on the table top finger.

15. A method of separating a short count clip of a predetermined number of sheets from a continuously building process stack comprising the steps of:

(a) building a stack on a table top finger by transferring cut sheets from a packer roll and delivering them to the stack from the roll by a packer fingers;

(b) moving a package building carriage downward as package height increases and moving a first count finger stop out of a count trip position and moving a second count finger stop into the count trip position, wherein a count finger drive bracket rotates into contact with a count finger trigger wear plate as the first count finger stop moves out of the count trip position;

(c) continuing to move the package building carriage downward as the packer fingers pack a final sheet on a first package causing a compact air cylinder to extend and pivot a cam outward causing a cam follower to follow the cam outward and pivot the count finger trigger and releasing a count finger drive bracket preloaded with torque from an air motor which drives a count shaft connected to the count finger drive bracket via a timing belt;

(d) rotating a count finger assembly until a count finger makes contact with a first package capturing the first package between the count finger and the table top finger and continuing to move the package building carriage downward until the count finger comes to rest in a horizontal position;

(e) causing a count shaft stop to hit the second count finger stop as the count finger comes to rest in a horizontal position in readiness to begin building a new package without contact between the count finger trigger wear strip and the count finger drive bracket and stopping the downward movement of the package building carriage;

(f) pushing the completed package along the table top fingers towards the belt conveyor;

(g) dropping a pusher finger by an amount sufficient to clear the count finger as it returns toward a home position and returning the package building carriage and table top finger toward a home position;

(h) moving the pusher finger up a sufficient amount to engage the newly building package;

(i) actuating the count finger assembly to rotate the count fingers out from beneath the package and supporting the package by the table top finger; and (j) causing the count shaft stop to hit the first count finger stop as the count finger comes to rest vertically clear of the package which is building and continuing the package on the table top fingers while moving the carriage downward along with the table top fingers.

16. The method of claim 15 wherein step (a) further comprises tamping cut sheets transverse to the stack such that the cut sheets are uniformly aligned in the stack.

17. A method of separating a short count package formed of a predetermined number of napkins from a continuously building process stack comprising the steps of:

(a) building a first package on a count finger by packing folded napkins received from a packer roll with packer fingers in a downward motion onto a count finger and dropping a previously built second package down to a set of table top fingers;

(b) continuing building the first package on the count fingers and pushing the previously built package with pusher fingers actuated by an air cylinder towards a conveyor belt nip adjacent the table top fingers;

(c) continuing building the first package on the count fingers and drawing the previously built package off the table top fingers by the conveyor belt nip;

(d) continuing building the first package on the count fingers and returning the pusher finger to a home position as the previously built package is pulled off the table top fingers;

(e) packing a final napkin on the first package by the packer fingers and signalling the compact air cylinder to extend and pivot a count finger trigger and release a count finger drive bracket causing a count finger drive to rotate;

(f) dropping the count finger from beneath the first package just after the count finger trigger releases the count finger drive bracket and driving the first package by a next count finger to cause the first package to come to rest against the table top fingers;

(g) causing a count shaft trigger to hit a first count finger stop as the count finger comes to rest horizontally to permit building a new package;

(h) moving the first count finger stop into a position for the next trip and moving a second count finger stop out of engagement with a count finger assembly and rotating the count finger drive bracket into contact with a count finger trigger wear plate; and (i) repeating steps (a)–(h) to provide separation of relatively short count packages from a continuously building stack.

* * * * *